US006014883A

United States Patent [19]

McClung

[11] Patent Number: 6,014,883

[45] Date of Patent: Jan. 18, 2000

[54] APPARATUS AND METHOD FOR FORMING CUP-SHAPED MEMBERS

[75] Inventor: James A. McClung, North Canton, Ohio

[73] Assignee: Can Industry Products, Inc., Canton, Ohio

[21] Appl. No.: 09/093,250

[22] Filed: Jun. 8, 1998

[51] Int. Cl.[7] ..... B21D 22/20

[52] U.S. Cl. ..... 72/347; 72/349; 72/350

[58] Field of Search ..... 72/329, 336, 347, 72/349, 350

[56] References Cited

U.S. PATENT DOCUMENTS

| | | | |
|---|---|---|---|
| 4,472,955 | 9/1984 | Nakamura et al. | 72/57 |
| 4,516,420 | 5/1985 | Bulso, Jr. et al. | 72/329 |
| 4,796,454 | 1/1989 | Bulso, Jr. et al. | 72/350 |
| 5,333,484 | 8/1994 | Mine et al. | 72/349 |
| 5,477,723 | 12/1995 | Kergen | 72/350 |
| 5,626,048 | 5/1997 | McClung | 72/336 |
| 5,628,224 | 5/1997 | McClung et al. | 72/336 |
| 5,634,366 | 6/1997 | Stodd | 72/348 |

*Primary Examiner*—Lowell A. Larson
*Assistant Examiner*—William Hong
*Attorney, Agent, or Firm*—Sand & Sebolt

[57] ABSTRACT

Apparatus and method for forming cup-shaped metal members from a flat metal sheet in a press having a ram which moves a cut edge, draw horn and draw pad towards a base holding a blank and draw die. The draw pad is formed with an annular outer rib which engages an opposed clamping surface of the die upon the peripheral edge of a disc blank moving around an inner radius of the die and into a cup forming cavity to maintain a space between the clamping surfaces of the draw pad and die of between 50% and 95% the thickness of the metal sheet to reduce excess pinching of the peripheral edge of the disk blank as it moves around the die radius as the draw horn draws the disk blank into the cup-shaped member.

15 Claims, 5 Drawing Sheets

FIG-2
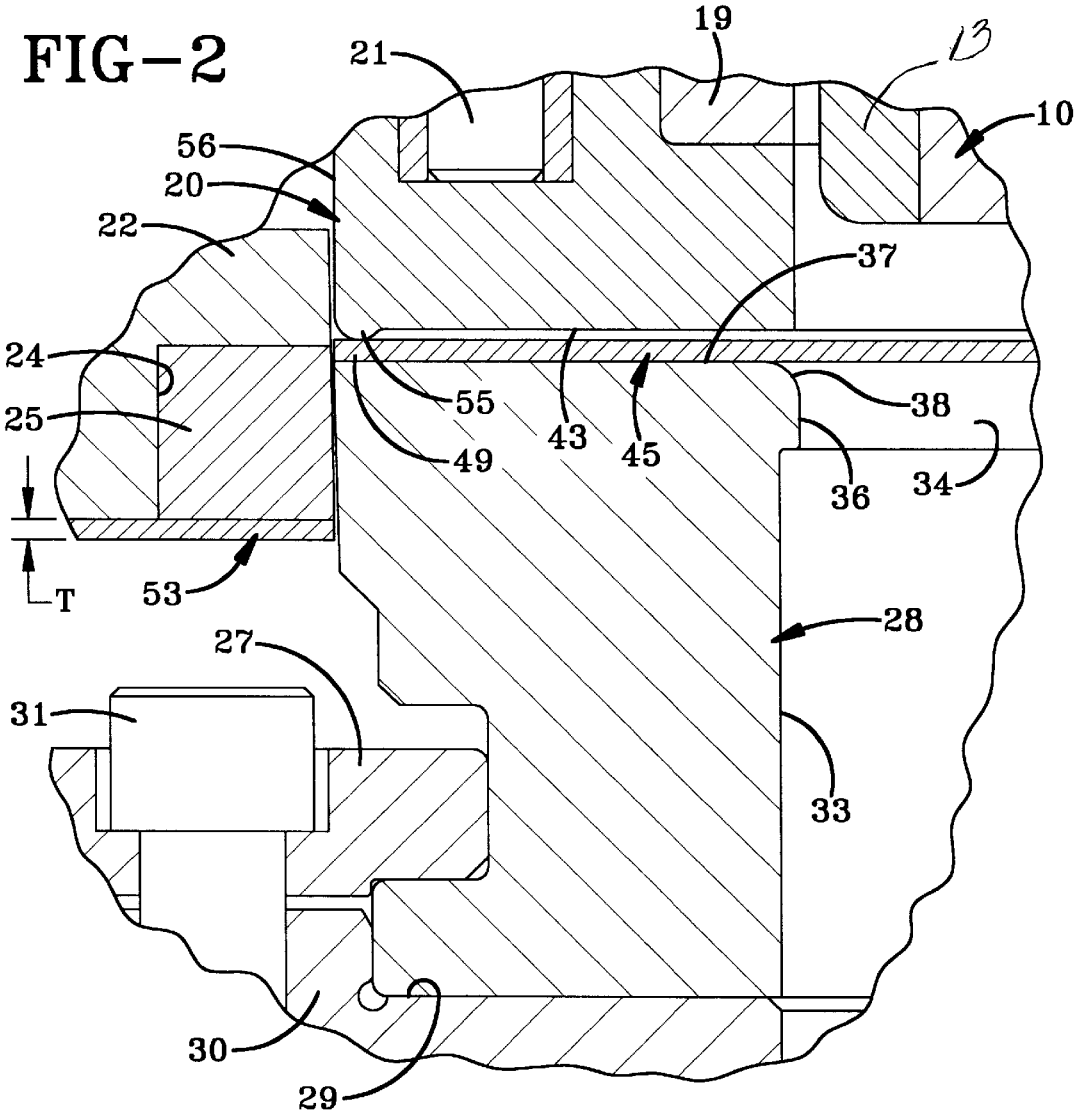
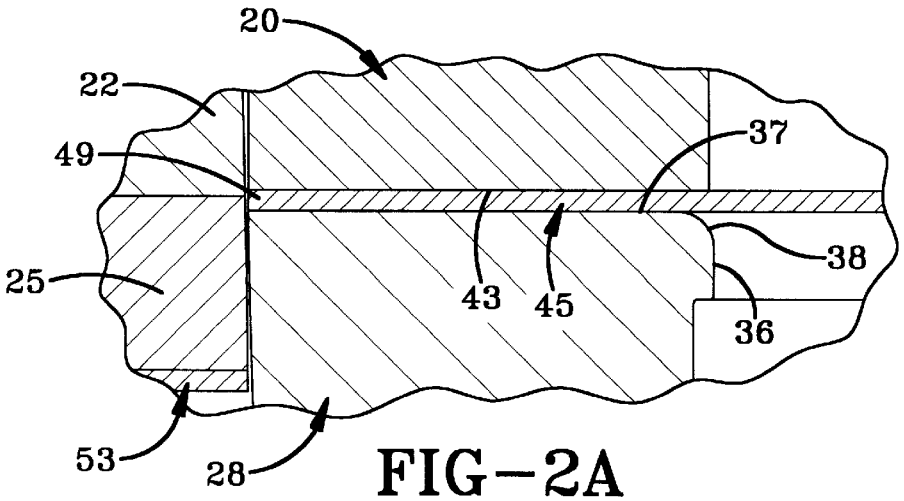
FIG-2A
PRIOR ART

FIG-4
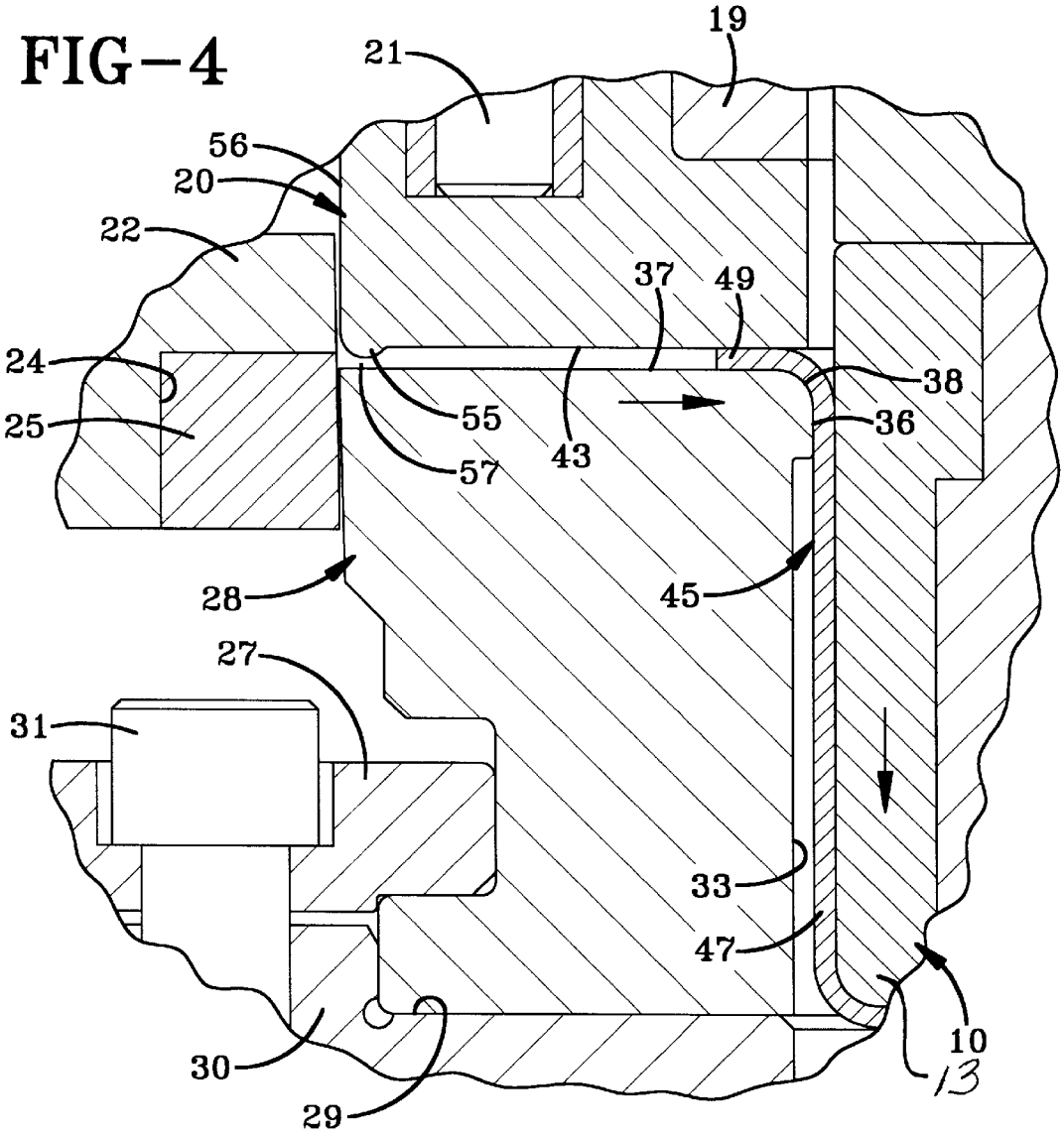
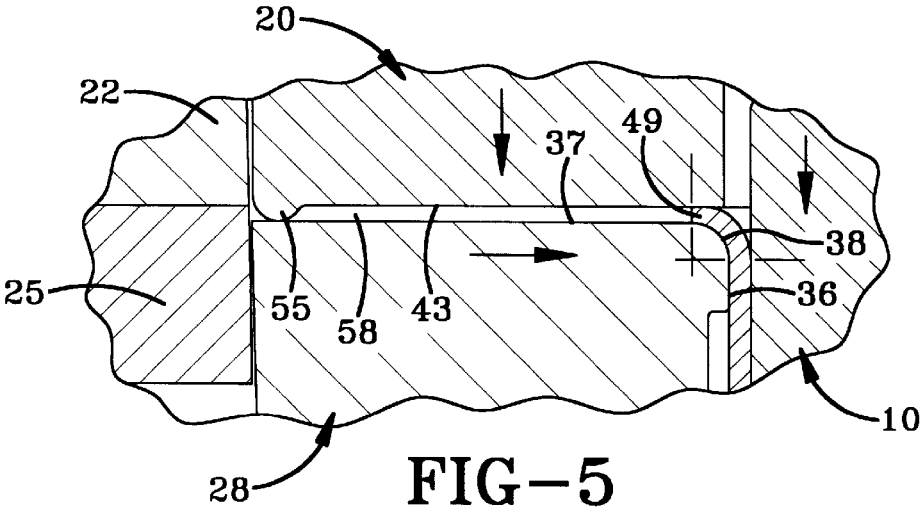
FIG-5

FIG-6
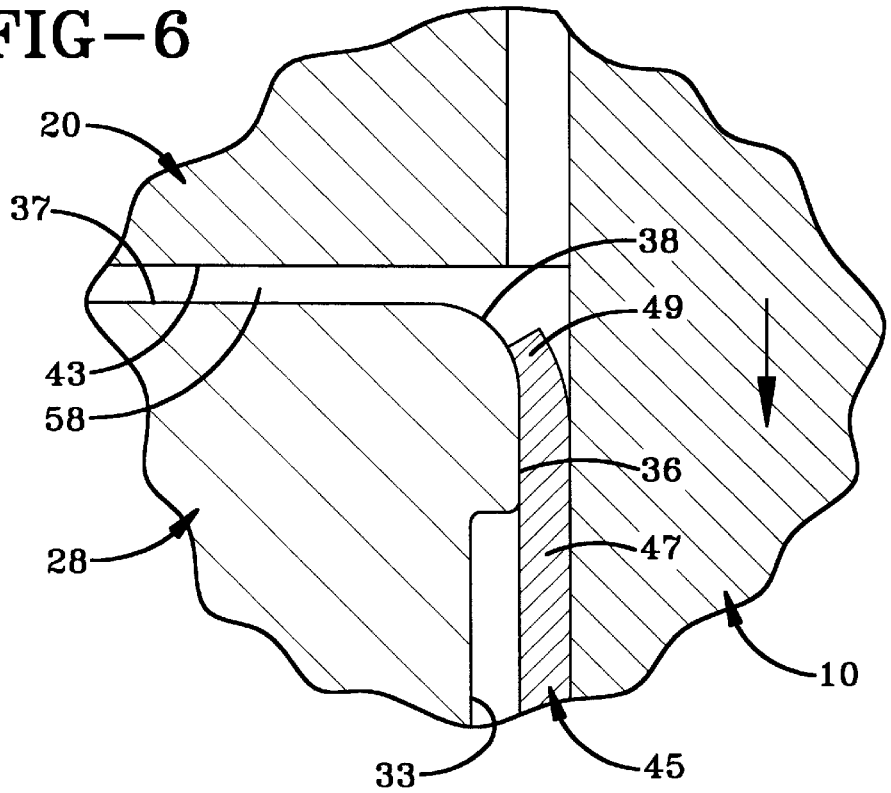
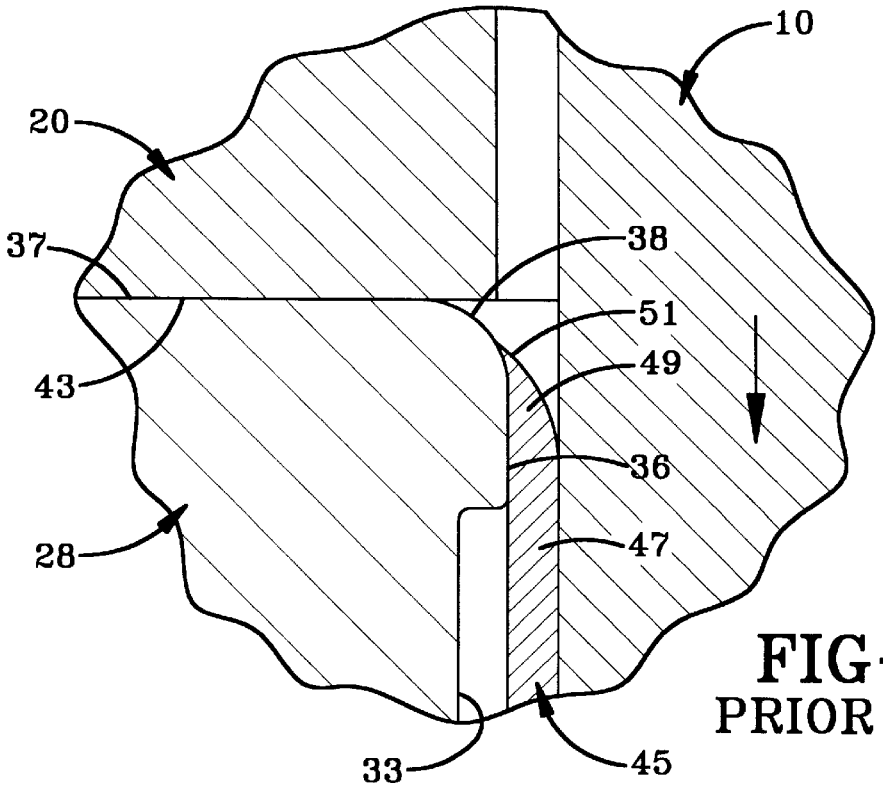
FIG-7
PRIOR ART

APPARATUS AND METHOD FOR FORMING CUP-SHAPED MEMBERS

BACKGROUND OF THE INVENTION

Technical Field

The invention relates to forming cup-shaped members such as container bodies from a blank of metal and in particular to forming such bodies in a press which reduces the wrinkling and splintering of the peripheral edge of a blank disk as it is drawn around the radius and into the opening of a blank and draw die by providing the draw pad with an annular rib which maintains a predetermined spacing between the opposed clamping surfaces of the draw pad and blank and draw die.

Background Information

It is well known in the container forming art to form two piece containers, that is containers in which the walls and bottom of the container are a one piece member and the top or end closure is a separate piece by stamping disk shaped blanks from a strip of metal sheet and then subsequently drawing the desired can body configuration into the disk blank in either a single or double acting press. Examples of such a method and apparatus are shown in numerous patents including U.S. Pat. Nos. 5,626,048 and 5,628,224. These patents as well as other prior art discloses that flat sheet material such as steel or aluminum, either in sheet or coil form, is initially blanked by an annular cutting edge and then drawn into a cup shape for further redrawing into a final container in the same press or in subsequent presses and operations. Generally these prior art presses will simultaneously form a plurality of container bodies in the single stroke of the single or double acting press.

However, one problem that is encountered with these prior art presses is that the peripheral edge of the disk blank is excessively pinched as it moves around the inner radius of the die opening into which the metal of the disk blank is being drawn by the draw horn to form the cup-shaped member by the pressure exerted thereon by the draw pad. In a double action press, the timing of the inner and outer ram is adjusted in an attempt to have the draw pad move upwardly in order to reduce the clamping pressure on the peripheral edge at the instant of time that the edge is moving around the radius and into the die opening. However, due to the extreme speeds that these presses operate and the metal thinness and tolerances between the parts of the die and press it is difficult to achieve the desired results. This excess pinching of the peripheral edge results in flattening the peripheral edge into an extremely sharp edge resulting in bits of metal splintering off from the disk and from a preapplied coating for certain strip materials. These splinters quickly affect the operation of the press and require maintenance repair and repair problems.

This pinching problem of the peripheral disk blank edge is also critical in a single action press where the clamping pressure exerted on the disk blank remains generally constant until the metal has been pulled from between the clamping surfaces of the draw pad and die by movement into the die opening by the draw horn and there is no mechanism for attempting to reduce the pressure on the draw pad at this critical instant in the forming operation.

Therefore, the need exists for an improved press and in particular apparatus therefor and to a method of forming a cup-shaped member which will enable the clamping pressure to be minimized on the peripheral edge of the disk shaped blank as it moves around the radius of the die as it is drawn into the die cavity by the draw horn to reduce excess pinching and with the resultant splintering of metal chips and slivers therefrom without requiring a substantial modification to the press or to its mode of operation.

SUMMARY OF THE INVENTION

Objectives of the invention include providing an improved apparatus and method for forming cup-shaped members such as container bodies in either a single or double acting press from sheet metal material wherein the material is blanked and drawn into a cylindrical cup-shaped configuration in a single stroke of the press which automatically prevents excessive clamping pressure being applied to the peripheral edge of the disk blank as it moves around the radius of the die cavity when being drawn into a cup shape by the draw horn.

Another objective is to provide such a method and apparatus which enables the desired amount of clamping pressure to be exerted on the disk blank as it is being drawn into the die cavity by the draw horn and which prevents the clamping pressure from excessively squeezing the peripheral edge of the blank disk into a pointed configuration with the resultant slivering of metal particles therefrom by providing the draw pad with an outer annular rib which automatically engages the clamping surface of the die shortly after the draw pad has begun to pinch the peripheral edge of the blank disk thereby limiting any subsequent movement of the draw pad against the peripheral edge which heretofore had produced the pointed configuration and slivered particles.

Another objective of the invention is to provide such a method and apparatus which requires relatively minor adjustments to existing press and die constructions and operations thereof, thus avoiding possibly modifications for retrofitting existing presses.

Another objective of the invention is to provide such a method and apparatus in which the rib has a height of between 50 and 95% of the thickness of the metal sheet and preferably 85% in order to achieve the most effective continued clamping of the peripheral edge of the blank disk without the resultant excessive pinching and slivering.

These objectives and advantages are obtained by the improved apparatus of the invention for use in forming a cup-shaped member from a metal sheet in a press having at least one ram and a base wherein the general nature of said apparatus includes a draw pad and a draw horn carried by the ram and a blank and draw die carried by the base in opposed relationship to the draw pad and draw horn, said draw pad and die having opposed annular clamping surfaces for releasably clamping a disk blank therebetween; a cutting edge carried by the ram and surrounding the draw horn for cutting the disk blank from the metal sheet; and the draw pad clamping surface having an outer rib extending therefrom for engaging the clamping surface of the die to maintain a predetermined spacing between the clamping surfaces of the die and draw pad as the draw horn advances into the die to form the cup-shaped member from the disk blank.

These objectives and advantages are further obtained by the improved method of the invention for forming a cup shape member from a metal sheet in a press having a base and a blank and draw die mounted thereon at least one ram for moving a draw horn and a cut edge toward the die wherein the general nature of said method includes the steps of feeding the metal sheet between the die and the draw horn, draw pad and cut edge; providing the draw pad and the die with opposed clamping surfaces with an outer rib projecting from the clamping surface of the draw pad toward the clamping surface of the die; advancing the cut edge, draw pad and draw horn toward the metal sheet and the die by movement of the ram; blanking a disk blank from the metal sheet by advancing the cut edge; releasably clamping an outer portion of the disk blank between the clamping surfaces of the draw pad and the die by applying a pneumatic clamping pressure on said draw pad with said rib being spaced from said die; continuing advancing the draw horn towards the disk blank to begin drawing the cup-shaped member from said disk blank; maintaining clamping pressure against the disk blank and a predetermined first space between the clamping surfaces of the draw pad and die until a peripheral edge of said disk blank commences movement around an inner radius of said die; and then continuing advancing the draw pad toward the die until the rib contacts the clamping surface of the die to maintain a predetermined second space between the clamping surfaces of the draw pad and die as the draw horn continues to advance and finishes drawing the cup-shaped member.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

FIG. 2 is an enlarged fragmentary sectional view showing the gap control feature of the invention at the start of a cup forming operation;

FIG. 2A is a fragmentary sectional view similar to FIG. 2 showing the prior art apparatus on which the present invention is an improvement thereon;

FIG. 4 is a view similar to FIGS. 2 and 3 showing the positions of the gap control apparatus with the peripheral edge of the disk shaped blank just prior to starting movement around the inner radius of the cup forming cavity;

FIG. 5 is a view similar to FIGS. 2, 3 and 4 showing the position of the apparatus as the peripheral edge of the disk shaped blank is moving into the cup forming cavity and out of contact with the clamping surfaces of the draw pad and die;

FIG. 6 is a greatly enlarged fragmentary cross sectional view of the peripheral edge of a cup shaped member when formed by the method and apparatus of the present invention; and FIG. 7 is a greatly enlarged fragmentary sectional view similar to FIG. 6 showing the peripheral edge of the cup shaped blank produced by the prior art apparatus as shown in FIG. 2A.

Similar numerals refer to similar parts throughout the drawings.

DESCRIPTION OF THE PREFERRED EMBODIMENT

Figure 1:
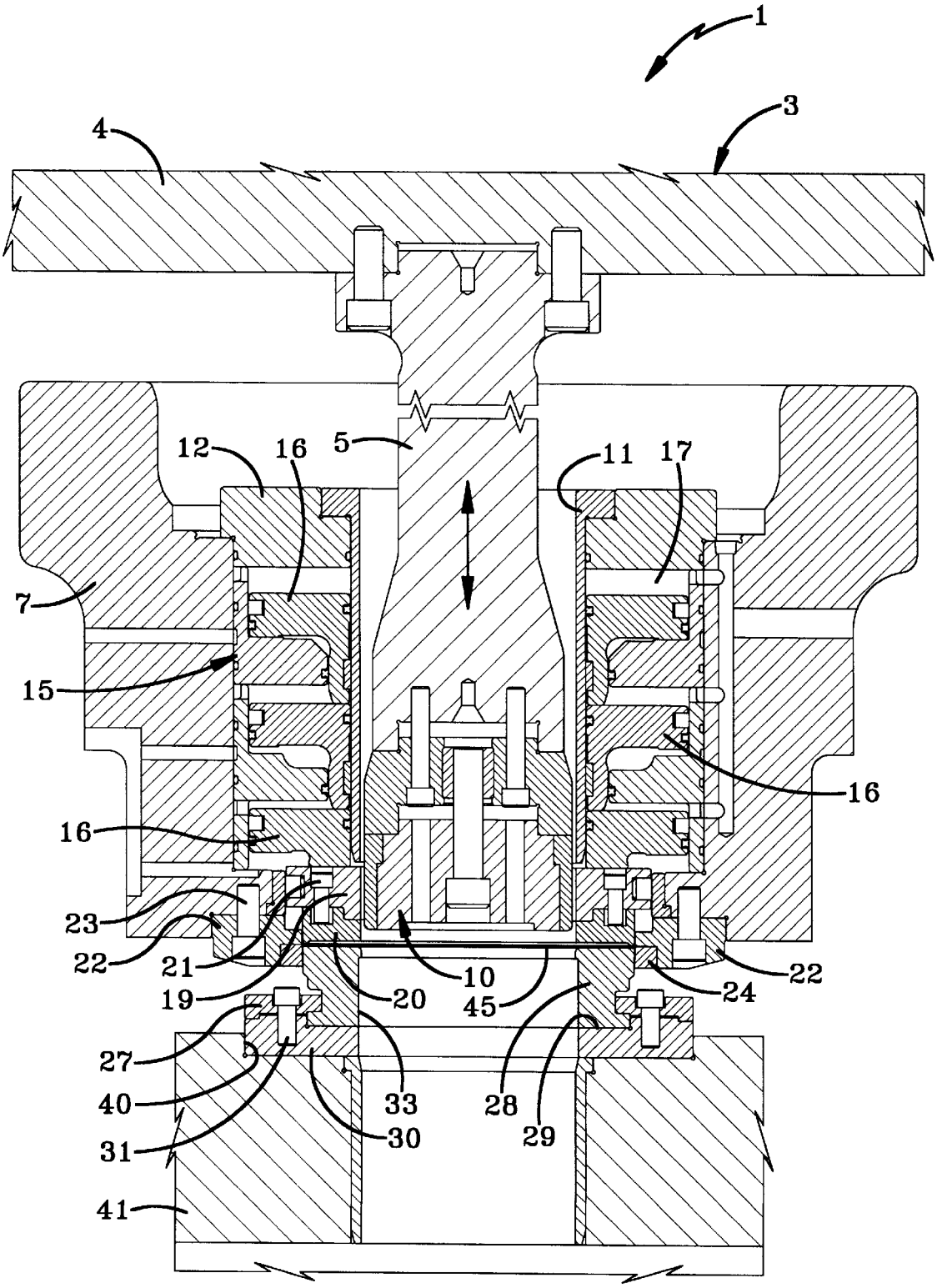
FIG. 1 is a fragmentary sectional view of a double action press for carrying out the method steps of the present invention and having the improved apparatus incorporated therein.

The method and apparatus of the present invention can be utilized in conjunction with a double acting press, examples of which are shown and described in U.S. Pat. Nos. 3,902,348; 5,626,048 and 5,628,224 and shown in FIG. 1 and indicated generally at 1. However, the method and apparatus are also utilized in conjunction with a single action press without affecting the invention. The main features of press 1 are described briefly below. Press 1 includes an inner ram indicated generally at 3, which includes a header plate 4, which is connected to an inner punch 5 and an outer frame 7 which surrounds punch 5 and which is connected to and controlled by an outer ram (not shown). A usual draw horn 10 is connected to the lower end of inner punch 5 and may be a usual one or two piece construction with the associated mounting bolts and air passages and is movable in a reciprocal vertical direction upon movement of ram 3 as is well known in the press art.

A cylindrical guide sleeve 11 surrounds draw horn 10 and is connected to an annular cap 12. Cap 12 is connected to outer frame 7 and forms the upper closure for a pneumatic piston assembly indicated generally at 15. The piston assembly may be of various constructions such as shown in U.S. Pat. Nos. 5,626,048 and 5,628,224 and consists of a plurality of vertically stacked pistons 16 reciprocally movably mounted within an annular bore or cylinder 17. The lowermost piston 16 engages a draw pad mounting ring 19 which in turn is connected to draw pad 20 by bolts 21. An annular retaining ring 22 is connected by bolts 23 to the lower end of outer frame 7 and is formed with an annular recess 24 in which an annular cut edge 25 is mounted. Draw horn 10 may be provided with a hardened outer annular case 13 as shown in the drawings or could be of a one-piece construction without affecting its manner of operation in the present invention. An annular draw die clamp 27 secures an annular blank and draw die 28 into an annular recess 29 formed in a retainer ring 30 by a plurality of bolts 31. Blank and draw die 28 is formed with an inner annular cavity or opening 33, the upper portion of which has a reduced diameter annular opening 34 defined by a cylindrical wall 36 which merges into a horizontal top clamping surface 37 by a forming radius 38. In the preferred embodiment, forming radius will be 0.125 inches. Retainer ring 30 is mounted within an annular recess 40 formed in a supporting base 41.

All of the above described components and features of press 1 are well known in the art and provide the preferred construction and environment in which the improved feature of the present invention is incorporated and the method steps carried out which is now described in further detail below.

In the usual operation of a single or double action press as shown in FIG. 2A, draw pad 20 will have a continuous flat annular clamping surface 43 which will clamp a disk blank 45 against top clamping surface 37 of blank and draw die 28 throughout its entire length under the pneumatic pressure applied by piston assembly 15 as draw horn 10 moves downwardly to form a cup-shape blank 47 (FIG. 4). Draw horn 10 moves the metal of disk blank 45 into die cavity 33 with the portion of blank 45 that is trapped between annular clamping surfaces 43 and 37, move inwardly towards die cavity 33. The pressure exerted by piston assembly 15 is sufficiently great to clamp the metal between surfaces 37 and 43 yet enable the metal to be pulled therefrom by the movement of the draw horn without stretching or thinning the metal. However, as the outer peripheral edge portion 49 of disk blank 45 reaches the inner end of clamping surface 37 generally at the start of forming radius 38, the pressure exerted by draw horn 10 on the very small area of the remaining metal will pinch the metal as it is moving outwardly from between clamping surfaces 37 and 43 so that as it exits the clamping area, it will cause a sharper tapered edge 51 to be formed thereon as shown in FIG. 7. This results in the splintering of small bits of metal or slivers of metal from the disk edge, which after a number of press operations will begin to foul up the dies and transfer mechanisms possibly damaging the same or requiring preventive maintenance and periodic cleaning causing the press operation to be stopped.

As described previously, this problem of splintering is reduced somewhat in a double action press by adjusting the timing cycles of the inner and outer rams so that as the inner ram, which drives draw horn, approaches its maximum downward stroke and the edge of the disk reaches curved forming radius 38, the outer ram will begin to move upwardly so that the amount of clamping pressure exerted by piston assembly 15 on draw pad 20 is reduced to eliminate or reduce this thinning and slivering of the disk end edges. However, such accurate control and timing is difficult to achieve to prevent such thinning and slivering of the disk edges.

This problem is avoided or materially reduced by the present invention by the providing of an annular rib 55, which preferably is formed integrally with draw pad 20. Rib 55 preferably begins at the outer cylindrical wall 56 of draw pad 20 and has a rounded nose-like configuration so as to provide for a one-piece draw pad member with a radius of approximately 0.05 inches. Rib 55 preferably has a height of between 50% and 95% of the thickness "T" of the sheet metal strip 53 from which disk blank 45 is formed with the preferred height being approximately 85% of thickness "T". Metal sheet 53 which is used for many containers formed from cup-shaped member 47 will be formed of aluminum and has a preferred thickness of 0.011 inches. Thus, in the preferred embodiment, rib 55 will have a height of 0.00935 inches or 85% of the metal sheet thickness. However, for various containers, the thickness of metal sheet or strip 53 from which the disk blank and container body are ultimately formed, will have a thickness of between 0.005 inches to 0.030 inches. This provides a range of heights for rib 55 depending upon the particular metal being utilized in forming cup shaped member 47. For example, for the preferred height of between 50% and 95% of the thickness of the metal sheet, which in the preferred embodiment was indicated as 0.011 inches, rib 55 will have a height range of between 0.00425 inches and 0.0255 inches.

Figure 3:
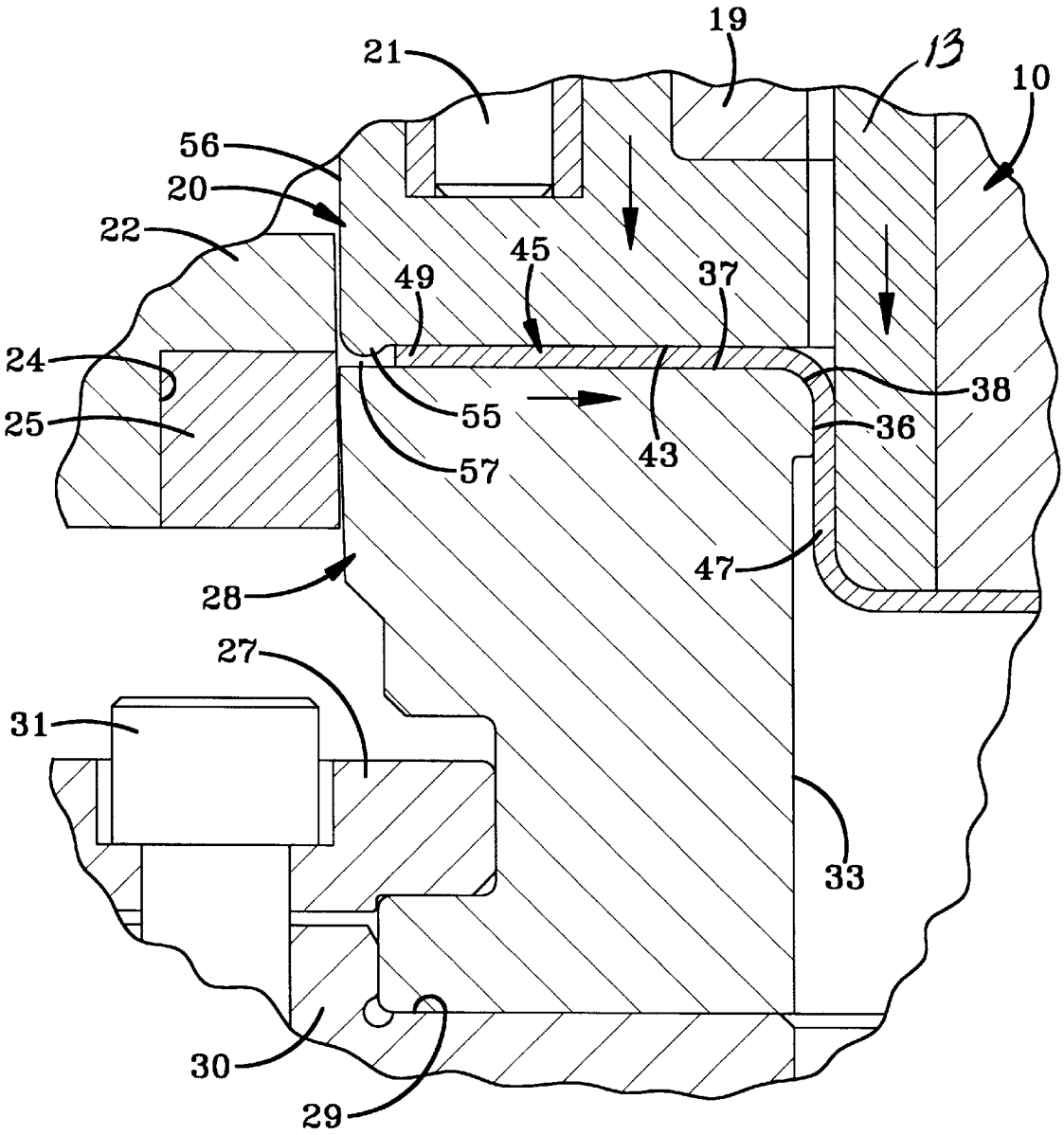
FIG. 3 is a view similar to FIG. 2 showing the location of the gap control apparatus after initial movement of the peripheral edge of the disk blank from beneath the control rib.

The manner of using the improved apparatus of the present invention and in particular the gap control provided by rib 55, for carrying out the unique method is best shown in FIGS. 2–6. Either before or after cut edge 25 severs metal strip 53 to form disk blank 45, draw horn 10 is moved downwardly whereupon rib 55 will press against the outer annular edge portion of blank 45 to sufficiently hold the blank in position until draw horn 10 is moved downwardly and into engagement with the center portion of blank 45. Continued movement of draw horn 20 into die cavity as shown in FIGS. 3 and 4, will cause rib 55 to release its clamping engagement with the outer edge portion of blank 45 as it slides inwardly between clamping surfaces 37 and 43. Annular clamping surface 43 will engage the metal blank and releasably clamp it against blank and draw die clamping surface 37 as shown in FIGS. 3 and 4, with sufficient pressure to hold it in position yet permit it to move inwardly as ram 3 continues to move draw horn 10 downwardly. Due to the height of rib 55 being less than the thickness of the metal, it will not engage clamping surface 37 leaving a small gap 57 therebetween, such as 15% of the metal thickness in the preferred embodiment.

However, rib 55 performs its intended function upon outer edge portion 56 of blank 45 reaching the start of the forming radius 38 as shown in FIGS. 4 and 5 where the undesirable crimping heretofore occurred. Rib 55 will bottom out against clamping surface 37 as shown in FIG. 5 due to the slight pinching of the metal in outer edge portion 49 caused by the continued downward pressure on draw pad 20 against this relatively small area of metal remaining between clamping surfaces 37 and 43. Thus, rib 55 will only permit a very small area of outer edge portion 49 to be compressed or pinched depending upon its height, since a control gap 58 (FIG. 5) will always be maintained between clamping surfaces 37 and 43 due to rib 55. In prior art presses clamping surfaces 37 and 43 would either contact each other as in a single action press, or come considerably closer as in a double acting press, resulting in the sharp edge 51 being formed in outer edge portion 49 as shown in FIG. 7.

Although the above sequence of operation and results achieved by the use of rib 55 is described in some detail above, in actual press operation, such movement of the various press components occurs in less than a second. However, as shown in the drawings and described above, rib 55 clearly prevents the formation of sharp edge 51 on cup-shaped member 47 thereby reducing the splintering of metal particles therefrom and from a coating which was previously applied for certain containers prior to it being formed into cup-shaped member 47. Also, this desired result is achieved in a relatively simple but effective manner by providing outer annular rib 55 on the outer portion of clamping surface 43 of draw pad 20, and which is effective for use in both a single and double acting press.

As shown in FIG. 6, a very slight crimping action will occur on outer edge portion 49 until rib 55 engages clamping surface 37. However, the amount of crimping is considerably less than that occurs without rib 55 as shown by a comparison of FIGS. 6 and 7. Furthermore, this slight crimping that occurs in end portion 49 even when using rib 55 will not result in the undesirable splintering of metal particles from the blank disk.

Accordingly, the improved apparatus and method for forming cup-shaped members is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purpose and are intended to be broadly construed.

Moreover, the description and illustration of the invention is by way of example, and the scope of the invention is not limited to the exact details shown or described.

Having now described the features, discoveries and principles of the invention, the manner in which the improved apparatus and method for forming cup-shaped members is constructed and used, the characteristics of the construction, and the advantageous, new and useful results obtained, the new and useful structures, devices, elements, arrangements, parts, combinations and method steps, are set forth in the appended claims.

I claim:

1. In combination, a metal sheet and an apparatus for forming a cup-shaped member from said metal sheet in a press having at least one ram and a base, said apparatus including:

a draw pad and a draw horn carried by the ram and a blank and draw die carried by the base in opposed relationship to the draw pad and draw horn, said draw pad and die having opposed clamping surfaces for releasably clamping a disk blank therebetween;

a cutting edge carried by the ram and surrounding the draw horn for cutting the disk blank from the metal sheet; and the draw pad clamping surface having an outer rib extending therefrom toward the clamping surface of the blank and draw die for releasably engaging an outer periphery of the disk blank and for subsequently engaging the clamping surface of said die to maintain a predetermined spacing between the clamping surfaces of the die and draw pad as the draw horn advances into the die to form the cup-shaped member from the disk blank, said rib having a height of between 50% and 95% of the thickness of the disk blank.

2. The combination defined in claim 1 in which the rib has a height of between 0.00425 and 0.0255 inches.

3. The combination defined in claim 2 in which the rib has a height of approximately 0.00935 inches.

4. The combination defined in claim 1 in which the rib has a smooth rounded nose configuration.

5. The combination defined in claim 4 in which the rounded nose of the rib has a radius of approximately 0.050 inches.

6. The combination defined in claim 1 in which the rib is formed integrally with the draw pad to provide a one piece member.

7. The combination defined in claim 1 in which the rib is annular.

8. The combination defined in claim 1 in which the rib has a height of approximately 85% of the thickness of the metal sheet.

9. A method of forming a cup-shaped member from a metal sheet in a press having a base and a blank and draw die mounted thereon, said die having a cavity and a forming radius at an entrance of said cavity; and at least one ram for moving a draw pad, a draw horn and a cut edge toward said die; said method includes the steps of:

A) feeding the metal sheet between the die and the draw horn, draw pad and cut edge;

B) providing the draw pad and the die with opposed clamping surfaces with an outer rib projecting from the clamping surface of the draw pad toward the clamping surface of the die;

C) advancing the cut edge, draw pad and draw horn toward the metal sheet and the die by movement of the ram;

D) blanking a disk blank from the metal sheet by advancing the cut edge;

E) providing the outer rib with a height of between 50% and 95% of the thickness of the disk blank;

F) initially clamping an outer edge portion of the disk blank between the rib and clamping surface of the die;

G) subsequently releasably clamping an outer portion of the disk blank inwardly of the outer edge portion between the clamping surfaces of the draw pad and the die by applying a pneumatic clamping pressure on said draw pad with said rib being spaced a predetermined first distance from the clamping surface of said die;

H) continuing advancing the draw horn towards the disk blank to draw the cup-shaped member in the die cavity from said disk blank;

I) maintaining clamping pressure against the disk blank by the draw pad and the predetermined first distance between the rib and the clamping surface of the die until a peripheral edge of said disk blank commences movement around the forming radius of said die; and J) and then continuing advancing the draw pad into the die cavity whereupon the rib contacts the clamping surface of the die to maintain a predetermined second space between the clamping surfaces of the draw pad and die as the draw horn continues to advance into the die cavity and finishes drawing the cup-shaped member.

10. The method defined in claim 9 including the step of providing the rib with a height of approximately 85% of the thickness of the metal sheet.

11. The method defined in claim 9 including performing step (D) before step (G).

12. The method defined in claim 9 including performing step (F) after step (D).

13. The method defined in claim 9 including the step of providing the rib with a smooth rounded nose.

14. The method defined in claim 9 including the step of providing the forming radius with a radius of approximately 0.125 inches.

15. The method defined in claim 9 including performing step (G) after step (D).

* * * * *